US008375960B1

(12) United States Patent
Pheng

(10) Patent No.: US 8,375,960 B1
(45) Date of Patent: Feb. 19, 2013

(54) MANICURE TOOL

(76) Inventor: Chanty Pheng, Cranston, RI (US)

( * ) Notice: Subject to any disclaimer, the term of this patent is extended or adjusted under 35 U.S.C. 154(b) by 105 days.

(21) Appl. No.: 13/009,888

(22) Filed: Jan. 20, 2011

(51) Int. Cl.
*A45D 29/18* (2006.01)

(52) U.S. Cl. ..... 132/73.5

(58) Field of Classification Search ..... 132/73, 132/73.5–73.6, 74.5, 75.3–75.4, 75.6, 75.8, 132/76.2, 76.4, 313, 317, 285–286, 229; 15/105, 106, 159.1, 160; 401/116–117; 403/122, 403/DIG. 1; 16/224; D4/119–121; 7/162
See application file for complete search history.

(56) References Cited

U.S. PATENT DOCUMENTS 1,231,270 A * 6/1917 Knudsen ..... 132/73.5
2,109,580 A * 3/1938 Troya ..... 132/73.5
3,428,286 A * 2/1969 Del Pesco ..... 248/474
3,436,160 A * 4/1969 Lanoie ..... 401/116
4,332,263 A * 6/1982 Kitrell ..... 132/73
4,398,800 A * 8/1983 Hayes ..... 359/818
D276,192 S * 11/1984 Fusco ..... D4/120
4,842,132 A * 6/1989 Wells ..... 206/229
5,074,695 A * 12/1991 DeRosa ..... 401/195
6,237,194 B1 * 5/2001 Williams ..... 16/430
7,013,674 B2 * 3/2006 Kretchmer ..... 63/5.1
8,231,294 B2 * 7/2012 Grossnass et al. ..... 401/32

* cited by examiner

*Primary Examiner* — Rachel Steitz
*Assistant Examiner* — Jennifer Gill
(74) *Attorney, Agent, or Firm* — Salter & Michaelson

(57) ABSTRACT

A manicure tool that includes an elongated housing shaped to be grasped by a user thereof to control the application of a nail polish to a finger nail or toe nail of a client; a brush supported at one end of the housing for controlling the application of the nail polish; a docking pad constructed and arranged to be engaged with the finger or toe at a location that is proximate to the finger nail or toe nail; and a pivot member for coupling the docking pad to the elongated housing at the one end of the elongated housing. The pivot member allows the housing to be pivoted relative to the docking pad and, in turn, controls the brush so as to be swept over the surface of the nail.

15 Claims, 11 Drawing Sheets

MANICURE TOOL

FIELD OF THE INVENTION

The present invention relates in general to a manicure tool and pertains, more particularly, to an improved and universal manicure tool that is particularly adapted for providing a French manicure.

BACKGROUND OF THE INVENTION

Various devices do exist for assisting in a French manicure. The usual procedure is to use a brush that is hand held. However, one problem with this technique is that because the brush is hand held, a proper French manicure with clean lines is not possible. In the prior art there are provided templates such as shown in U.S. Pat. No. 5,398,704 to Dombeck.

However, this requires a rather complex set up and still does not provide an effective technique for providing a proper French manicure.

Accordingly, it is an object of the present invention to provide an improved manicure tool and one that is particularly adapted for providing a French manicure.

Another object of the present invention is to provide a nail polish applicator that can be used for a variety of purposes in addition to performing a French manicure.

Still a further object of the present invention is to provide an improved manicure tool that is easy to operate and that is relatively simple in construction and that can be manufactured in an economical manner.

SUMMARY OF THE INVENTION

To accomplish the foregoing and other objects, features and advantages of the present invention there is provided a manicure tool that includes an elongated housing shaped to be grasped by a user thereof to control the application of a nail polish to a finger nail or toe nail of a client; a brush supported at one end of the housing for controlling the application of the nail polish; a docking pad constructed and arranged to be engaged with the finger or toe at a location that is proximate to the finger nail or toe nail; and a pivot member for coupling the docking pad to the elongated housing at the one end of the elongated housing. The pivot member allows the housing to be pivoted relative to the docking pad to, in turn, control the brush so as to be swept over the surface of the nail.

In accordance with other aspects of the present invention the brush is constructed and arranged to provide a French manicure; the brush preferably has an arcuate tip; the brush is supported at the housing so as to be slideable longitudinally; the brush is slideable between positions more and less remote from said housing including a slide button for controlling the translation of the brush; and preferably a carriage for supporting the brush enabling sliding action thereof. The docking pad is preferably removably attached to the pivot member; and the docking pad may be supported from the pivot member by a detachable magnet means. The docking pad also preferably includes means for securing the docking pad to the finger or toe; wherein the means for securing includes one of a pair of legs and a ring. The tool housing may also include a second brush supported at an opposite end of the housing and a manual button or wheel for adjusting the position of the second brush relative to the housing.

In accordance with another feature of the present invention there is provided a nail polish applicator that includes an elongated housing shaped to be grasped by a user thereof to apply a nail polish to a finger nail or toe nail of a client; a brush supported at one end of the housing for controlling the application of the nail polish; a docking pad constructed and arranged to be engaged with the finger or toe at a location that is proximate to the finger nail or toe nail; and a pivot member for coupling the docking pad to the elongated housing at the one end of the elongated housing. The pivot member allows the housing to be pivoted relative to the docking pad and, in turn, controls the brush so as to be swept over the surface of the nail.

In accordance with other aspects of the present invention the brush may be constructed and arranged to provide a French manicure, and the brush has an arcuate tip; the brush is supported at the housing so as to be slideable longitudinally between positions more and less remote from said housing, and including a slide button for controlling the translation of the brush; the docking pad is removably attached to the pivot member, and includes means for securing the docking pad to the finger or toe; and including a second brush supported at an opposite end of the housing, and including a manual button for adjusting the position of the second brush relative to the housing.

In accordance with another aspect of the present invention there is provided a method for applying a French Manicure to a toe or finger nail comprising: providing an elongated housing shaped to be grasped by a user thereof to control the application of a nail polish to a finger nail or toe nail of a client by means of a brush supported at one end of the housing for controlling the application of the nail polish; providing a docking pad constructed and arranged to be engaged with the finger or toe at a location that is proximate to the finger nail or toe nail; and pivoting the housing relative to the docking pad to, in turn, control the brush so as to be swept over the surface of the nail. A further step is linearly adjusting the position of the brush between positions more and less remote from the housing.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
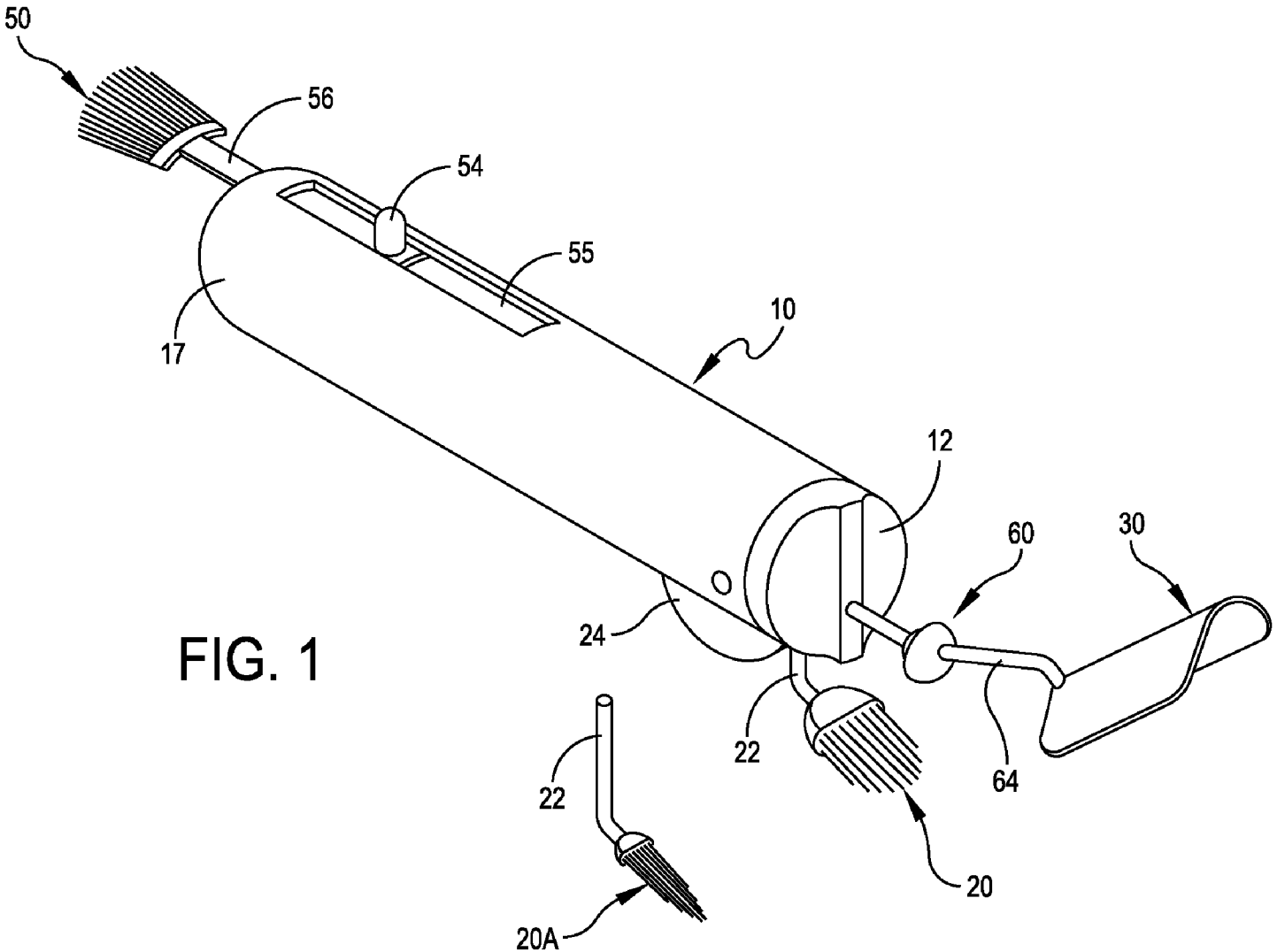
FIG. 1 is a perspective view of the preferred embodiment of the manicure tool of the present invention.
Figure 2:
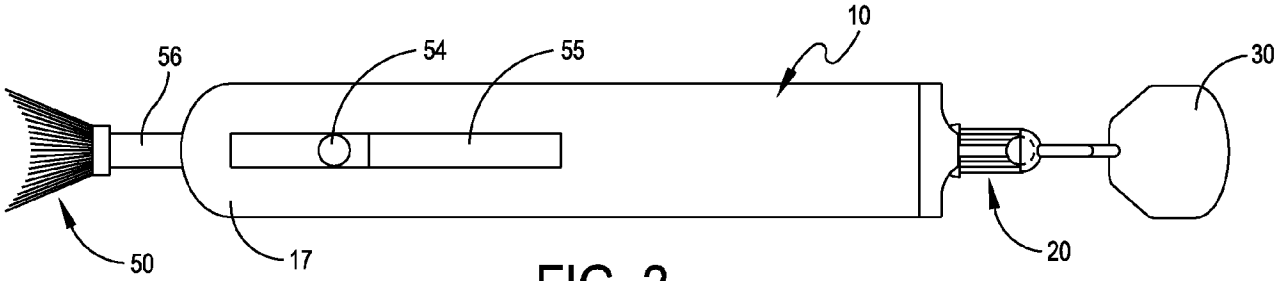
FIG. 2 is a top view of the manicure tool of FIG. 1.
Figure 3:
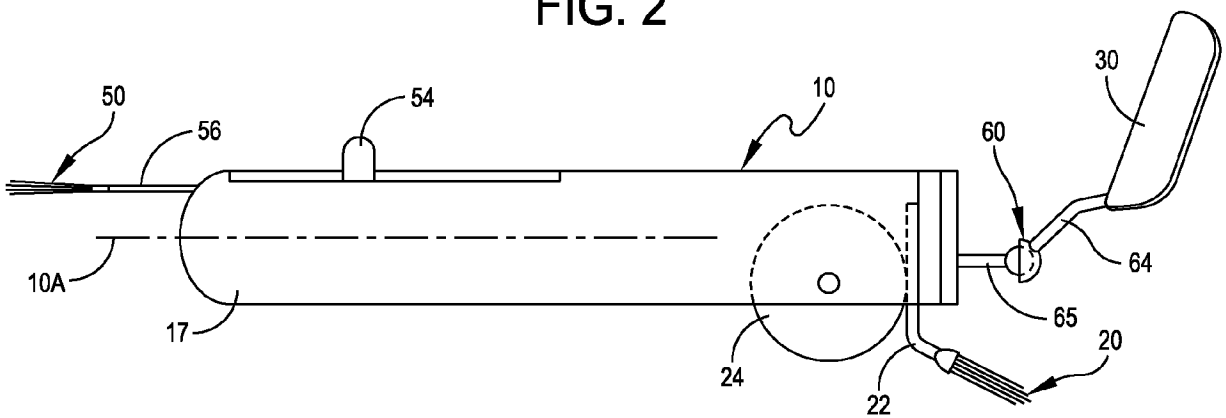
FIG. 3 is a side view of the manicure tool of FIG. 1.
Figure 4:
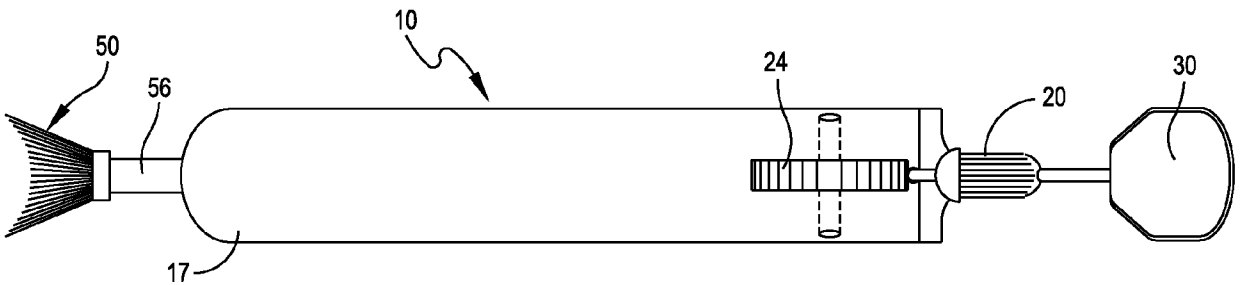
FIG. 4 is a bottom view of the manicure tool of FIG. 1.

In the following description there are basically two different procedures that are set forth relating to providing a French manicure. The French manicure usually involves providing a white tip on the nail. As mentioned previously, this is usually done by hand. However, in accordance with the present invention there is now provided a tool that essentially has a docking section that enables the tool to be readily pivoted from the finger, thumb or toe so as to allow a brush, attached thereto, to be swept in a manner to either provide a demarcation line or to remove previously applied polish to provide a smooth curvature.

As illustrated in the drawings herein, the manicure tool is comprised basically of an elongated housing or frame 10. As illustrated in the drawings, the housing 10 is an elongated shape and is basically cylindrical having brushes at opposed ends thereof. The elongated housing 10 is shaped to be grasped by a user thereof to control the application of a nail polish or nail polish remover to a finger nail, thumb nail or toe nail of a client.

Figure 10:
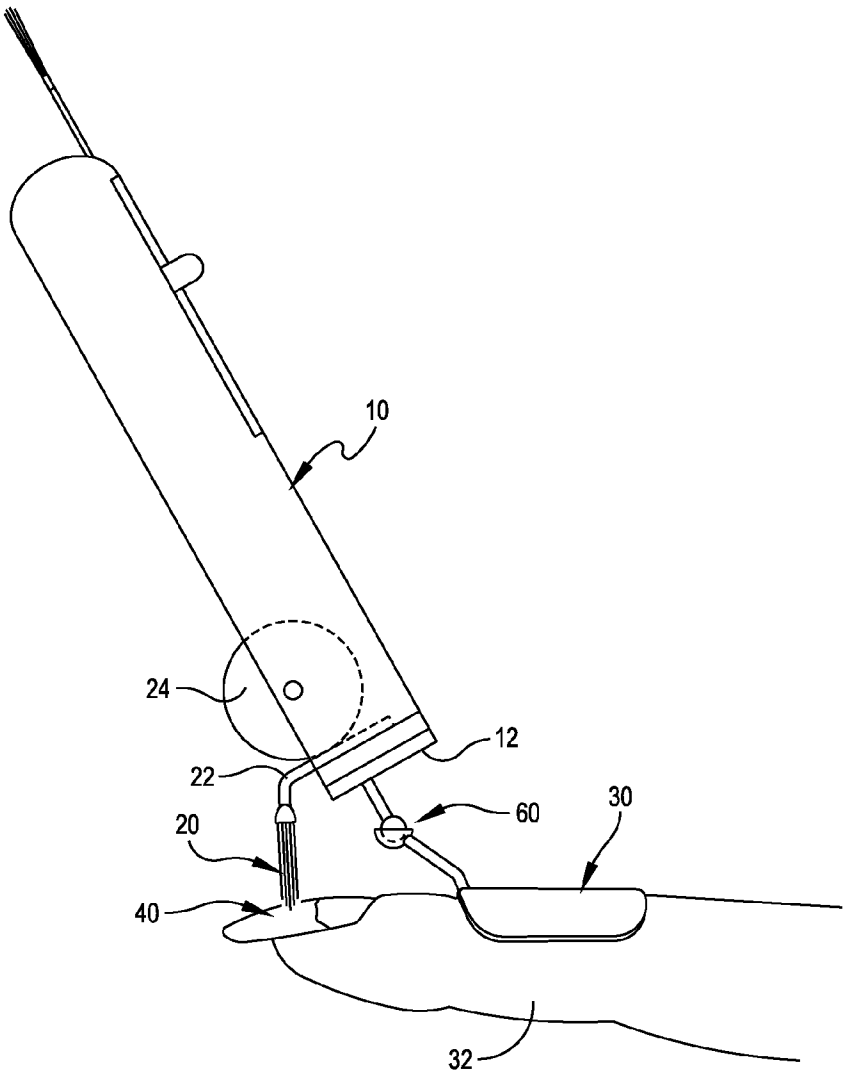
FIG. 10 illustrates the manicure tool of the present invention in a next step in which the docking pad is rested upon the finger and the brush is in contact with the finger nail.

A brush 20 is supported at one end of the housing 10 and is adjustable in position. Adjacent to the brush 20 there is provided a docking pad 30 that is preferably detachably supported from the housing at the end 12. The docking pad 30, such as illustrated in FIG. 10 is constructed and arranged to be engaged with the finger, thumb or toe at a location that is proximate to the finger, thumb or toe nail 40. See the illustration of FIG. 10 wherein the docking pad 30 is disposed on the finger 32 close to the nail 40.

Reference to FIG. 1 illustrates one of the brushes 20 attached with the housing 10 and a supplemental brush 20A that is smaller and narrower than the wider brush 20. Each of these brushes is supported by an angled support leg 22. The narrower brush 20A is used in one of the procedures described herein for providing a thin demarcation line of a nail polish or nail enamel.

Figure 6:
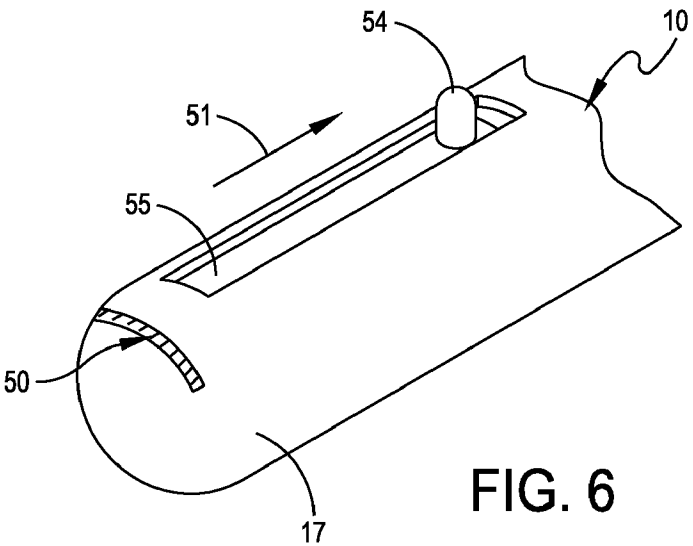
FIG. 6 is a view similar to that depicted in FIG. 5 showing the brush in the "stowed" position.
Figure 7:
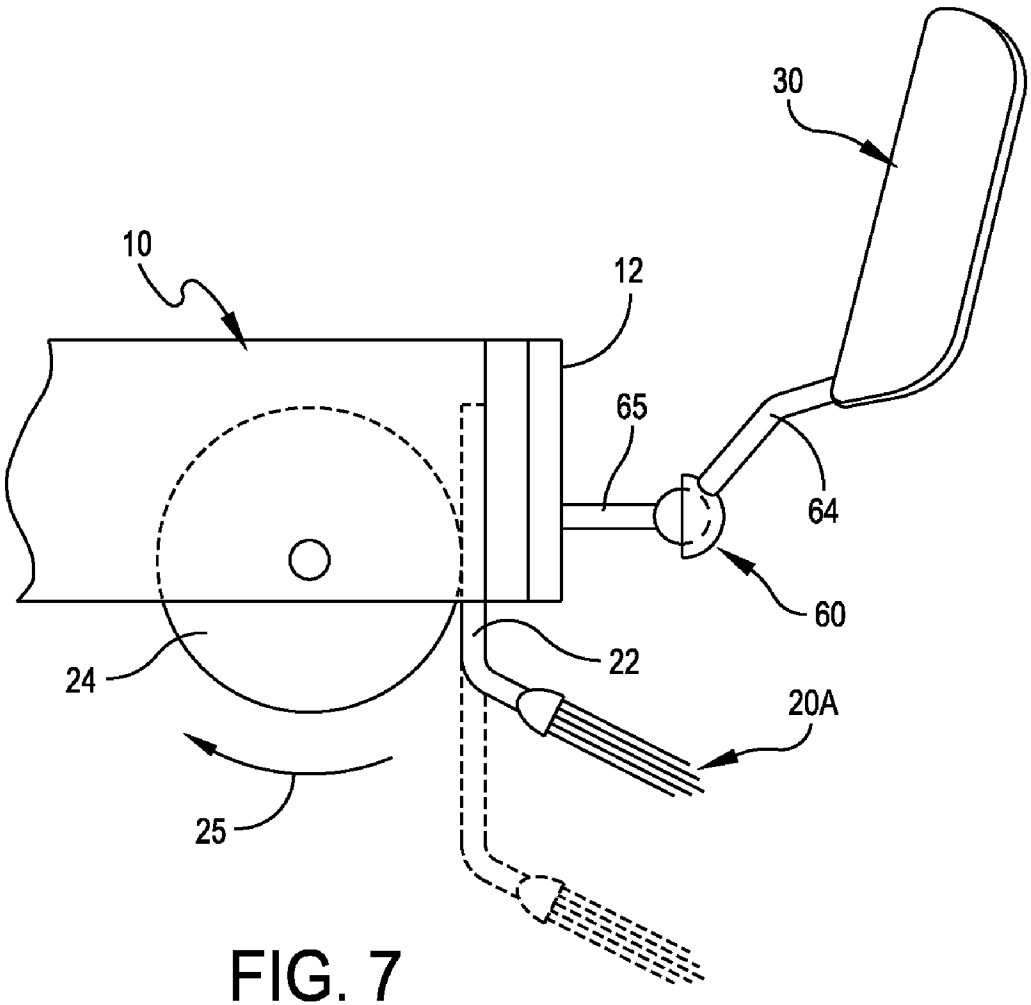
FIG. 7 is a fragmentary side view showing the front brush being removed or adjusted in position by rotating the lower wheel of the tool.

As depicted in FIGS. 1-7, each of the brushes is supported by an angled leg 22. The leg 22 is meant to engage with the housing 10 adjacent to an adjustment wheel 24. The leg of the brush may be frictionally engaged between the wheel 24 and a wall of the housing. As depicted in FIG. 7, by rotation of the wheel 24 in the direction of arrow 25, the position of the brush may be adjusted between a position shown in solid outline and an extended position shown in dotted outline in FIG. 7.

Figure 5:
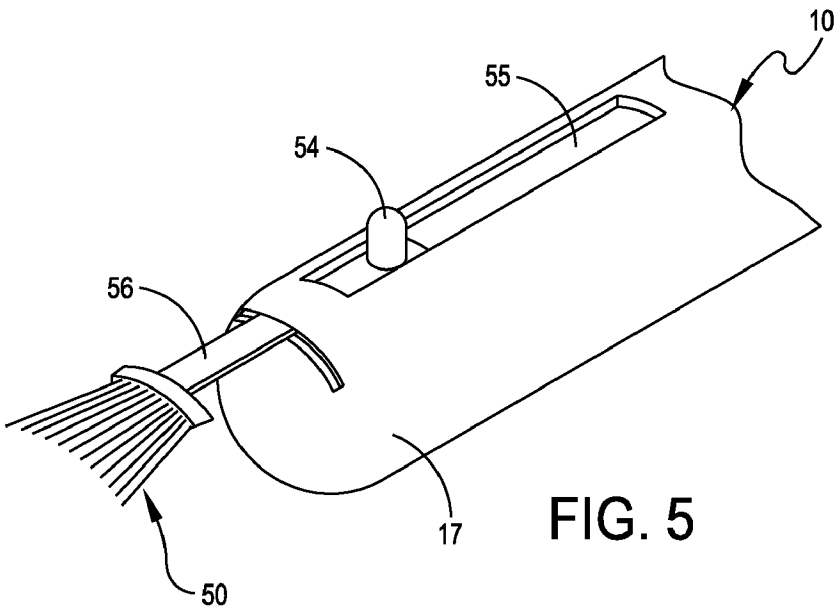
FIG. 5 is a fragmentary perspective view of the rear brush in the "in use" position.

Reference is now made to FIGS. 1-6 for an illustration of a second brush 50 that is supported at the opposite end 17 of the housing 10. The brush 50 is also adjustable in a longitudinal direction of arrow 51, as depicted in FIG. 6. FIG. 5 actually illustrates the brush 50 in an extended position while FIG. 6 illustrates the brush 50 in a stowed position. These two positions are controlled by means of a slide button 54 that is mounted in the housing 10. The button 54 can slide within the slot 55 in the housing to the different positions as illustrated in FIGS. 5 and 6. The button 54 attaches to a shaft 56 that supports the brush 50. The brush 50 provides an additional means for the application of a nail polish or a nail polish remover.

Figure 11:
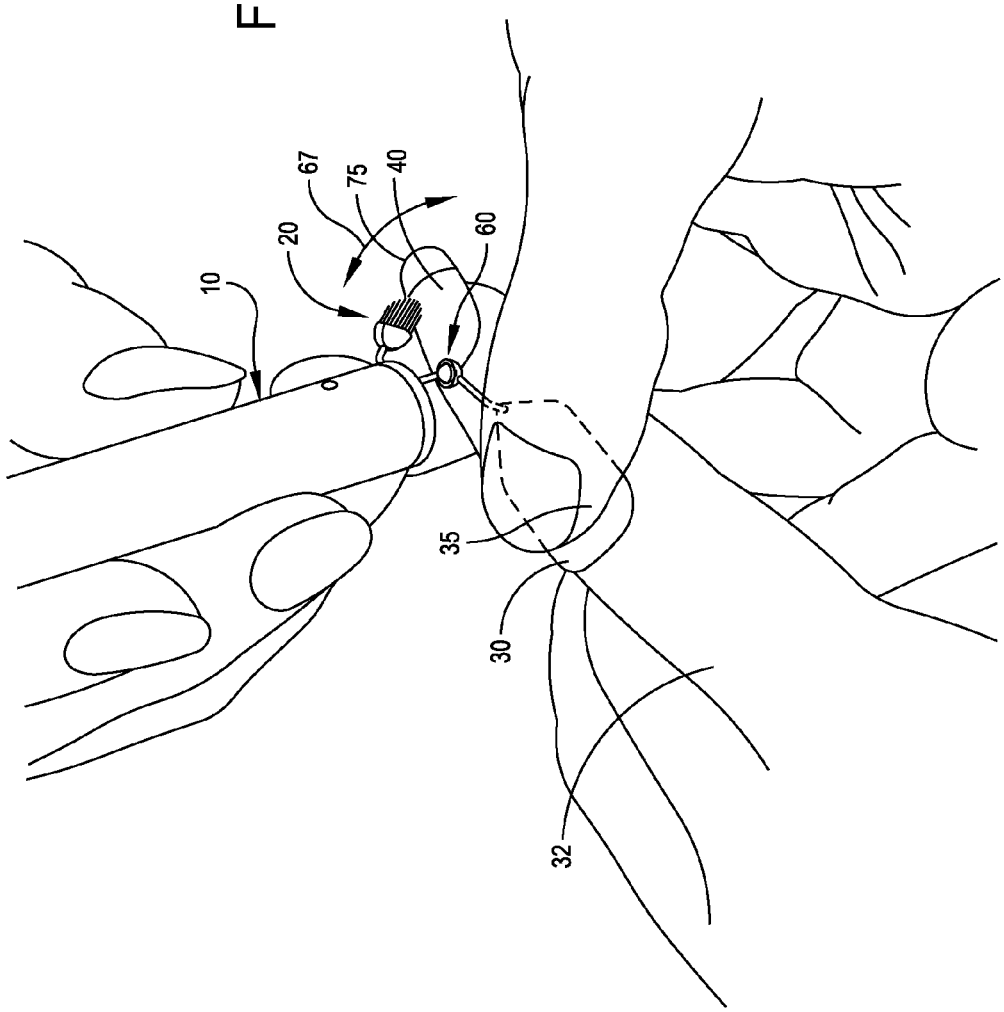
FIG. 11 is a perspective view illustrating a third step in which a polish remover may be applied to the front brush and the tool is rotated cleaning off the polish and creating a uniform curve on the nail.

The docking pad 30 preferably has a concave shape so that it matches the contour of the finger 32, as depicted in FIG. 10. FIG. 11 shows the docking pad 30 being held in place by means of the thumb 35. The docking pad 30 is preferably constructed of a relatively rigid material and may be constructed, for example, of plastic or thin metal.

Figure 8:
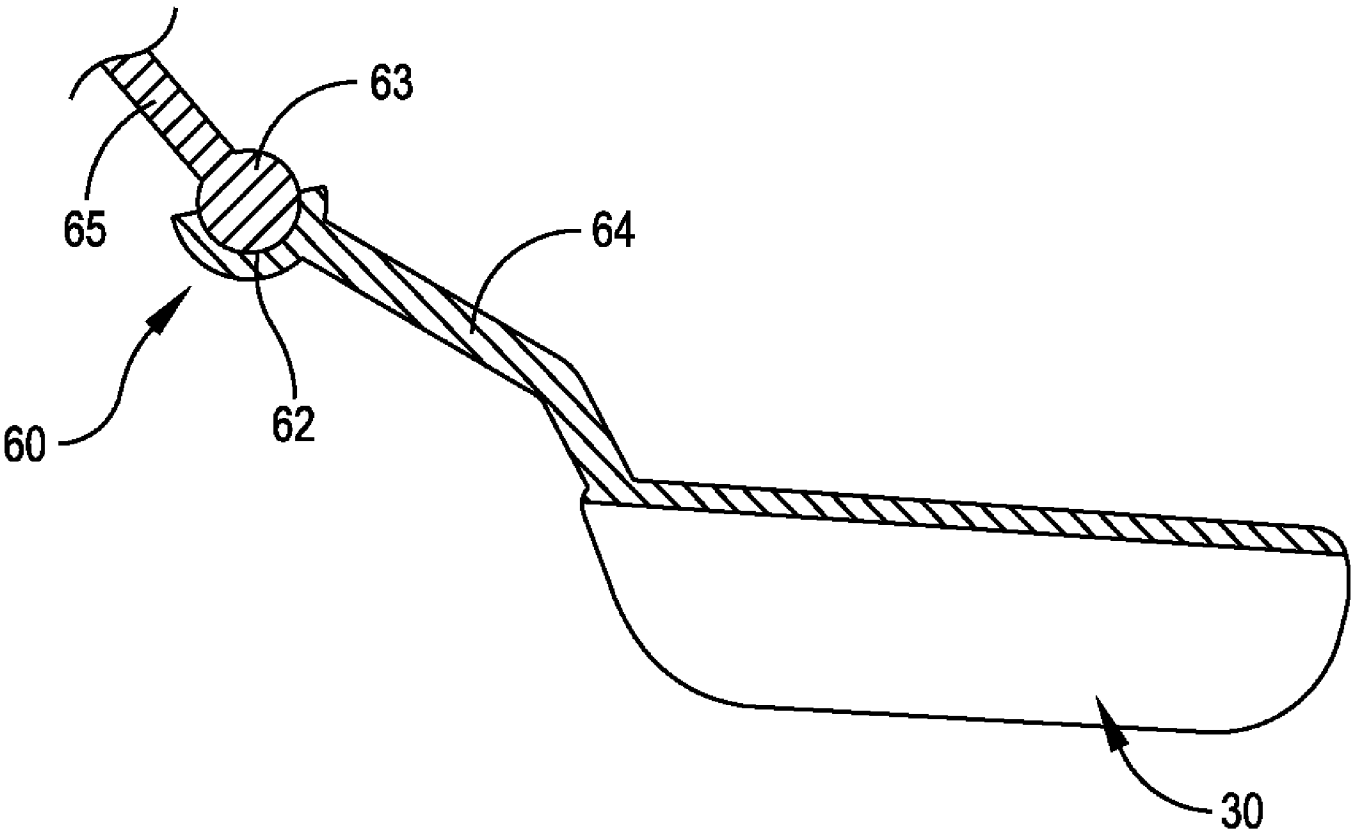
FIG. 8 is a fragmentary side view showing the finger rest or docking pad and the rotational interconnection.

The manicure tool of the present invention is also provided with a pivot member for coupling the docking pad to the elongated housing at the end 12 of the elongated housing. In this regard, reference may be made to FIGS. 1, 7 and 8. This pivot member is preferably of a type that will enable the docking pad 30 to be removed from the elongated housing 10. One embodiment is illustrated herein in FIGS. 7 and 8 in the form of a ball and socket 60. The ball and socket 60 includes a socket member 62 and an engaging ball 63. This ball and socket arrangement may be constructed so that it is joined by a magnet. The magnet can be formed as part of either the ball or socket and the other portion would then be a metal such as steel. As depicted in FIG. 8, the socket 62 is connected by arm 64 to the docking pad 30 and ball 63 is coupled to the housing by means of arm 65. The pivot member allows the housing to be rotated allowing a pivoting of the brush. The docking pad remains stationary during this procedure. Refer to FIG. 11 for an illustration of the pivoting at the ball and socket 60 shown by means of the arrow 67. Refer also to the same pivoting action illustrated in FIG. 14 in connection with the brush 20A.

It is noted that both the brush 20 and the brush 50 preferably have an arcuate tip at the ends of the bristles.

Figure 9:
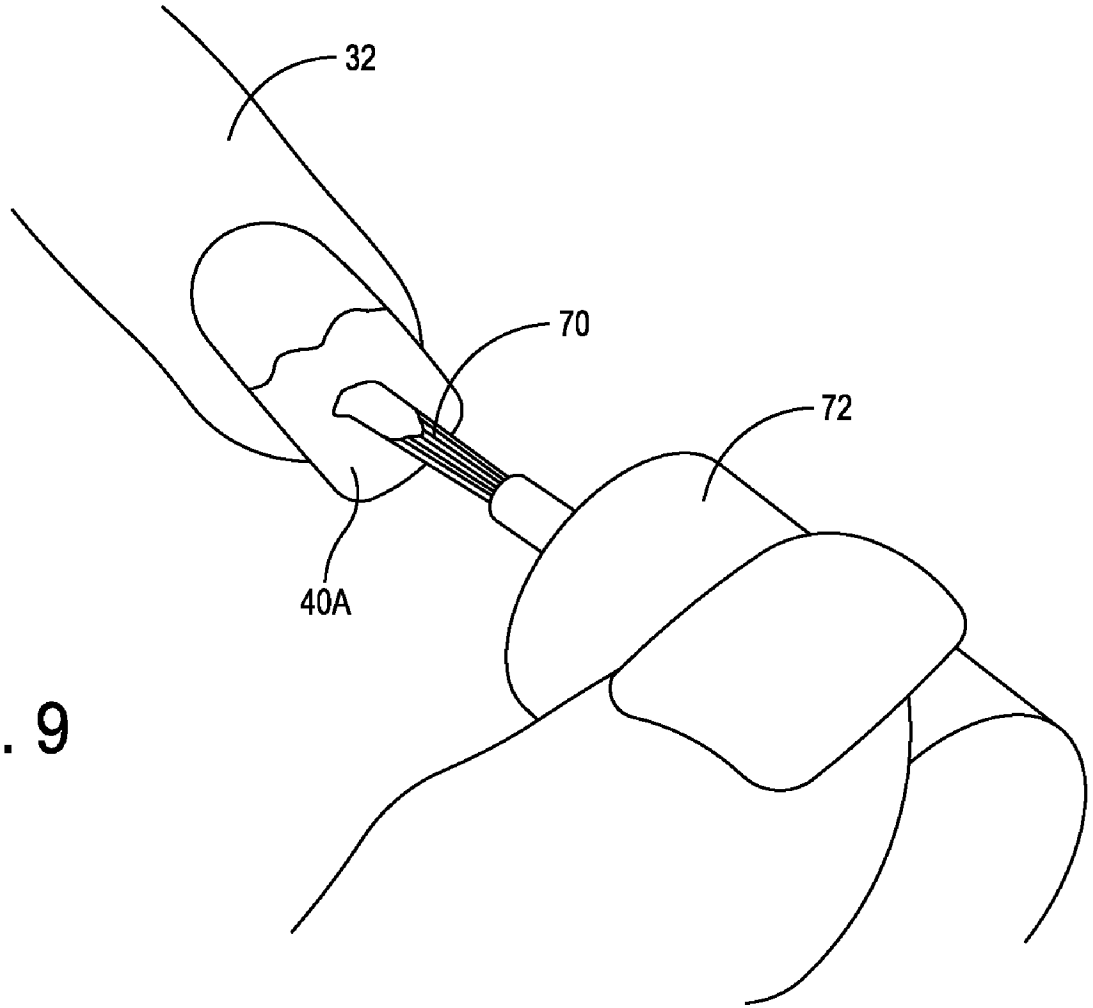
FIG. 9 illustrates a first embodiment of a French manicure procedure in which the nail polish is being applied to the nail by hand.
Figure 12:
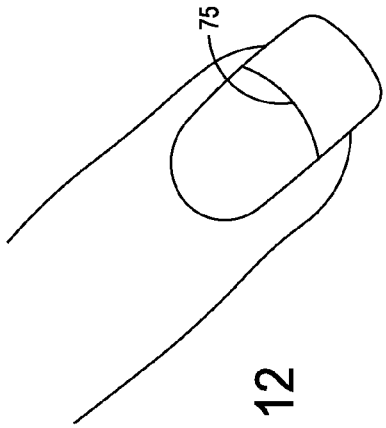
FIG. 12 illustrates the completed nail.

As indicated previously in, for example, FIG. 11, the docking pad 30 can be held in place by the thumb 35. Alternatively, the docking pad 30 may be provided with either a pair of side legs or a ring. This is illustratively depicted in FIG. 13 at 39. If opposed legs are used then the pad can simply be urged over the finger and held in place by the legs. Alternatively, if a ring is used then the pad can be slid on the finger and thus held in place. This may be advantageous in that one may not need then to hold the pad in place. Reference is now made to FIGS. 1-12 for a first technique used in forming a French manicure using the manicure tool of the present invention. This preferably uses the wider brush 20 which may be adjusted as depicted in FIG. 7 between different positions closer to or remote from the housing 10. This adjustment would depend upon the placement of the docking pad 30 as well as the length of the particular nail being worked upon. FIG. 9 depicts the application of a nail polish from a separate brush 70, as from a nail polish bottle 72. As noted in FIG. 9, the polish is administered at 40A but in a somewhat uneven manner. FIGS. 10-12 illustrate a next step in which the brush 20A is used to create a smooth demarcation line. For this purpose a nail polish remover may be applied to the brush 20 and this is where the tool is used to rotate the brush 20 in the direction of arrow 67 to remove part of the nail polish and provide a clean edge between the nail polish and the edge. Do to the arcuate nature of the tip of the brush, this will provide an arcuate surface as indicated at 75 in FIGS. 11 and 12. As indicated previously, this sweeping motion occurs by means of rotation of the housing 10 about longitudinal axis 10A (see FIG. 3).

Figure 13:
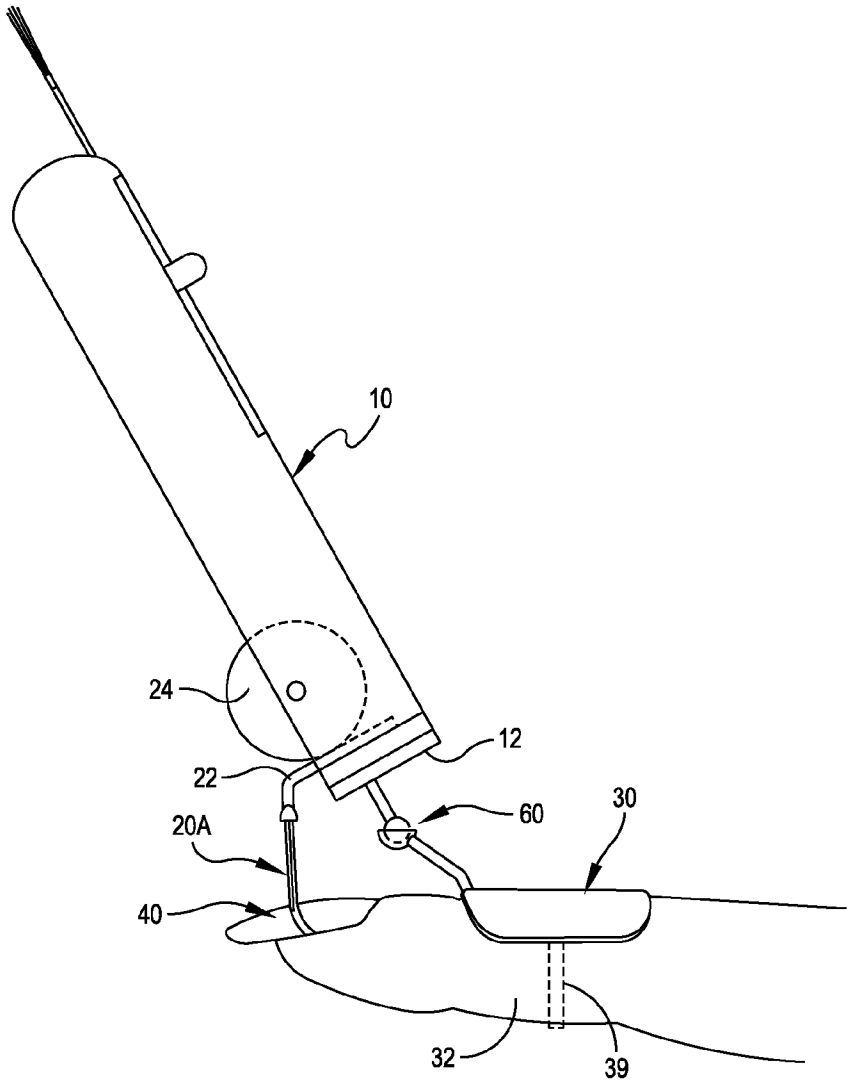
FIG. 13 illustrates a different procedure for providing a French manicure in which a small brush is used for providing a demarcation line.
Figure 14:
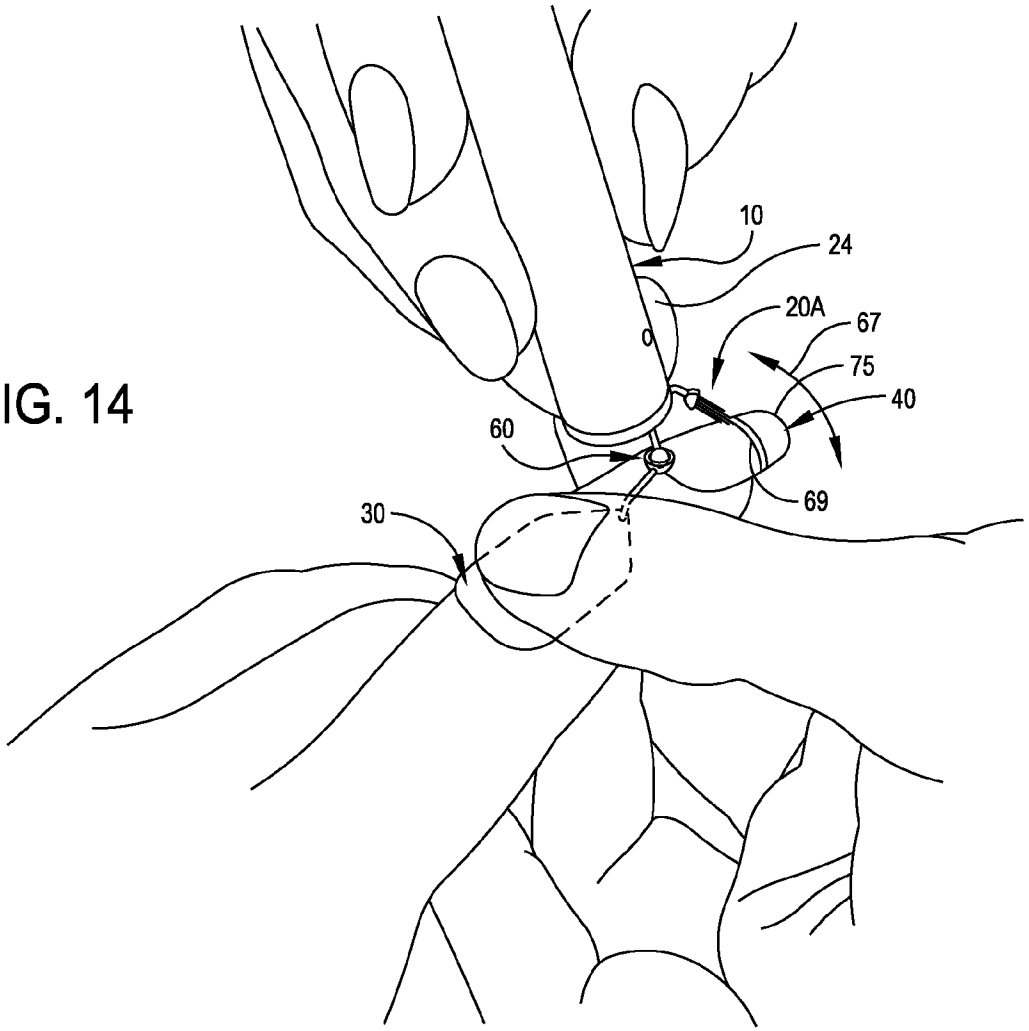
FIG. 14 is a perspective view illustrating the manner in which the brush is rotated to provide a small line placed on the nail.
Figure 16:
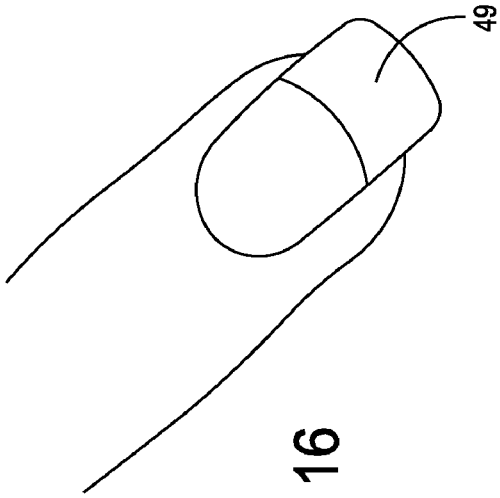
FIG. 16 shows the completed nail.
Figure 15:
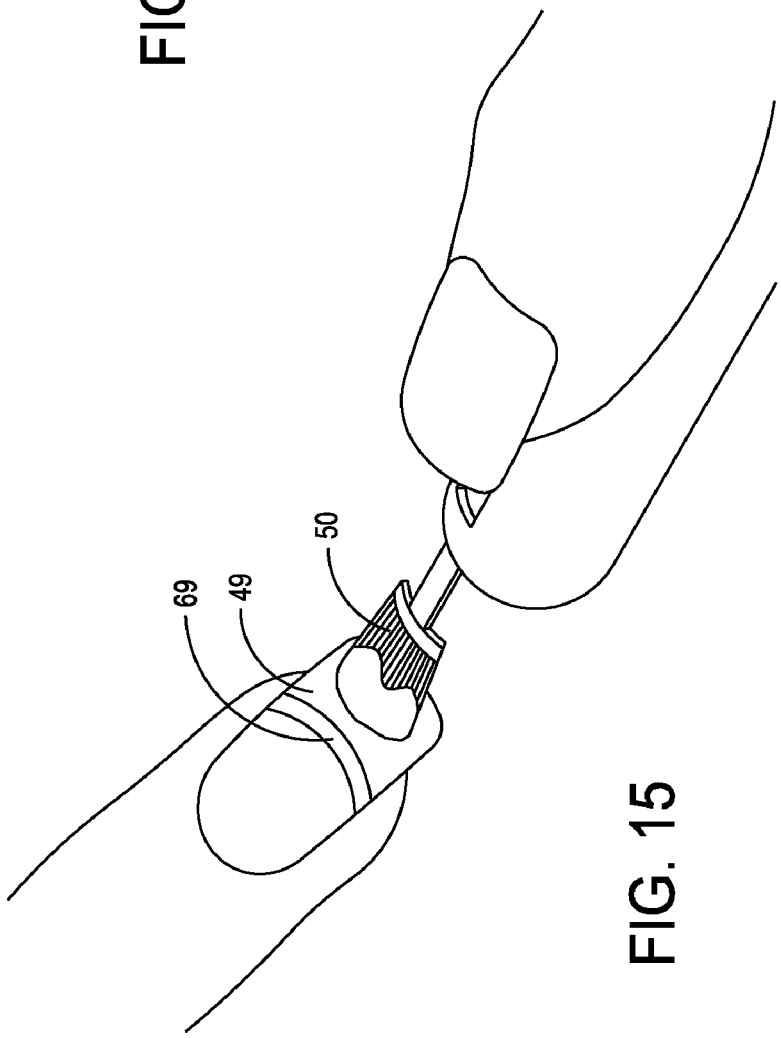
FIG. 15 is a perspective view showing a next step of applying polish which may be by hand to fill in the remainder of the nail area.

Reference is now made to FIGS. 13-16 for an alternate technique in forming a French manicure. For this technique, the narrow brush 20A is employed. FIG. 13 shows the manner in which the docking pad 30 is held in place either by the legs or ring 39 or by the finger as indicated in FIG. 14. The brush 20A has a nail polish applied thereto and this, being a narrow brush, when swept in the direction of arrow 67 as depicted in FIG. 14, causes a narrow nail polish demarcation line indicated at 69 in FIG. 14. Once this step has occurred, then further nail polish may be applied by the brush 50 as depicted in FIG. 15 to essentially fill in the area 49 with more nail polish. Because there is presently a narrow band 69 of nail polish previously applied by the brush 20A, one can then easily fill in the area 49 and provide a finished nail as illustrated in FIG. 16.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A manicure tool comprising:

an elongated housing shaped to be grasped by a user thereof to control the application of nail polish to a finger nail or toe nail of a client, and having a longitudinal axis;

a brush supported at one end of the housing for controlling the application of the nail polish;

a docking pad constructed and arranged to be engaged with the finger or toe at a location that is proximate to the finger nail or toe nail; and a pivot member for coupling the docking pad to the elongated housing at the one end of the elongated housing;

said pivot member allowing the housing to be pivoted relative to the docking pad and, in turn, controlling the brush so as to allow the brush to be swept over the surface of the nail;

said pivot member comprising a ball and socket arrangement including a first arm for connecting one of the ball and socket to the elongated housing, and a second arm for connecting the other of the ball and socket to the docking pad, the brush supported from the elongated housing to enable a sweeping motion.

2. The manicure tool of claim 1 wherein the brush has an arcuate tip.

3. The manicure tool of claim 1 wherein said brush is supported in the housing so as to be slideable longitudinally.

4. The manicure tool of claim 3 wherein said brush is slideable relative to the housing.

5. The manicure tool of claim 4 including an adjustment wheel for controlling the sliding of the brush.

6. The manicure tool of claim 1 wherein the docking pad is removably attached to the pivot member.

7. The manicure tool of claim 1 wherein the ball and socket arrangement is joined by a magnet.

8. The manicure tool of claim 1 wherein the docking pad includes at least one ring for securing the docking pad to the finger or toe.

9. The manicure tool of claim 1 including one of a pair of legs and a ring for securing the docking pad to the finger or toe.

10. The manicure tool of claim 1 including a second brush supported at an opposite end of the housing.

11. The manicure tool of claim 10 including a manual button for adjusting the position of the second brush relative to the housing.

12. A nail polish applicator comprising:

an elongated housing shaped to be grasped by a user thereof to apply a nail polish to a finger nail or toe nail of a client;

a brush supported at one end of the housing for controlling the application of the nail polish;

a docking pad constructed and arranged to be engaged with the finger or toe at a location that is proximate to the finger nail or toe nail; and a pivot member for coupling the docking pad to the elongated housing at the one end of the elongated housing;

said pivot member allowing the housing to be pivoted relative to the docking pad and, in turn, controlling the brush so as to be swept over the surface of the nail;

wherein said brush is constructed and arranged to provide a French manicure, the brush has an arcuate tip, and the pivot member comprises a ball and socket arrangement joined by a magnet.

13. The nail polish applicator of claim 12 wherein said brush is supported at the housing so as to be slideable longitudinally between positions more and less remote from said housing, and including an adjustment wheel for controlling the sliding of the brush.

14. The nail polish applicator of claim 12 wherein the docking pad is removably attached to the pivot member, and includes one of a leg and ring for securing the docking pad to the finger or toe.

15. The nail polish applicator of claim 12 including a second brush supported at an opposite end of the housing, and including a manual button for adjusting the position of the second brush relative to the housing.

* * * * *